US010355362B2

(12) United States Patent
Lester et al.

(10) Patent No.: US 10,355,362 B2
(45) Date of Patent: Jul. 16, 2019

(54) POWER AMPLIFIER SYSTEM WITH INTEGRATED ANTENNA

(71) Applicant: Freescale Semiconductor, Inc., Austin, TX (US)

(72) Inventors: David Paul Lester, Phoenix, AZ (US); Gregory J. Durnan, Tempe, AZ (US); Michael Watts, Scottsdale, AZ (US)

(73) Assignee: NXP USA, Inc., Austin, TX (US)

( * ) Notice: Subject to any disclaimer, the term of this patent is extended or adjusted under 35 U.S.C. 154(b) by 156 days.

(21) Appl. No.: 15/254,227

(22) Filed: Sep. 1, 2016

(65) Prior Publication Data

US 2018/0062241 A1 Mar. 1, 2018

(51) Int. Cl.
*H01Q 1/38* (2006.01)
*H01Q 9/30* (2006.01)
*H01Q 1/44* (2006.01)

(52) U.S. Cl.
CPC ..... *H01Q 9/30* (2013.01); *H01Q 1/44* (2013.01)

(58) Field of Classification Search
CPC ..... H01Q 1/24
USPC ..... 343/702, 720
See application file for complete search history.

(56) References Cited

U.S. PATENT DOCUMENTS 8,781,409 B2 7/2014 Peng et al.
2006/0220977 A1* 10/2006 Ogino ..... H01Q 1/38 343/866
2016/0198530 A1 7/2016 Piel et al.

* cited by examiner

*Primary Examiner* — Graham P Smith

(57) ABSTRACT

A system with an integrated antenna includes a housing having a first surface and a second surface. The second surface of the housing defines a recess. A substrate is attached to first surface of the housing, and an amplifying device having an output node is on the substrate. An antenna is attached to the second surface of the housing over the recess. A conductive element is positioned through at least a portion of the housing. The conductive element electrically connects the antenna to the output node of the amplifying device. The conductive element is connected to the antenna at an antenna feed point over the recess in the housing.

18 Claims, 8 Drawing Sheets

POWER AMPLIFIER SYSTEM WITH INTEGRATED ANTENNA

TECHNICAL FIELD

Embodiments of the subject matter described herein relate generally to systems with integrated antennas, and more particularly to the integration of an antenna into a power amplifier system incorporating a power amplifier transistor.

BACKGROUND

Antennas convert electrical energy into radio waves and received radio waves into electrical energy. Antennas are typically used in combination with a radio frequency transmitter or generator, in which the transmitter or generator is configured to generate radio frequency electrical signals based upon a suitable input signal. Those radio frequency electrical signals are communicated to the antenna through a transmission line. When the radio frequency electrical signals are applied to the antenna, the antenna, in turn, radiates the energy from the electrical signal as radio waves.

Radio frequency power amplifiers are electronic amplifiers that convert a relatively low-power input signal into a high-power radio frequency signal for transmission or energy transfer via a suitably-configured antenna or radiation element. Radio frequency power amplifiers typically include power transistors that generate the high-power signal and control that signal's application to the system's antenna.

In conventional power amplifier designs, each additional component and each additional connection between components of the radio frequency power amplifier system may burden the manufacturing of the system. The additional connections can increase losses, reducing amplifier efficiency, and can increase the risk that the system may function improperly or fail—particularly when those connections are made by an end user installing or constructing the radio frequency power amplifier system. As such, it may be desirable to simplify the fabrication of radio frequency power amplifier systems in a manner that may minimize the losses between the radio frequency power amplifier and the antenna of the radio frequency power amplifier system.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

The following detailed description is merely illustrative in nature and is not intended to limit the embodiments of the subject matter or the application and uses of such embodiments. As used herein, the words "exemplary" and "example" mean "serving as an example, instance, or illustration." Any implementation described herein as exemplary or an example is not necessarily to be construed as preferred or advantageous over other implementations. Furthermore, there is no intention to be bound by any expressed or implied theory presented in the preceding technical field, background, or the following detailed description.

In radio frequency power amplifier systems, it can be preferable to implement the systems in compact and robust packages. Such an approach can reduce the likelihood of failures in the connections between the components of the system and may also simplify the installation of the radio frequency power amplifier system into a larger device or product configured to utilize the radio frequency power amplifier system.

Accordingly, embodiments of the inventive subject matter include a radio frequency power amplifier system including an integrated antenna structure. The radio frequency power amplifier system includes a housing. A power amplifying device such as a power transistor is mounted to a circuit board that is, in turn, attached the housing. As described herein, the housing may include a heat sink structure configured to extract heat from the power transistor. The heat sink structure may be formed of the same material as the housing, or may be a separate structure mounted to the housing. The housing also includes an antenna structure that is mounted to or otherwise formed over or within at least a portion of the housing. A conductive connector, which may function as the system's transmission line, is installed within the housing to form an electrical connection between the power transistor and the antenna. In one embodiment, the conductive connector passes through holes formed in the substrate, housing, and antenna in order to couple the power transistor to the antenna.

The present disclosure, therefore, provides a radio frequency power amplifier system having integrated power transistor and antenna structures. The resulting configuration can simplify the manufacturing process for the present radio frequency power amplifier system because the antenna is directly incorporated into the system, rather than being a separate component. Additionally, the present design may simplify the installation of the radio frequency power amplifier system into end-user products, as compared to traditional radio frequency power amplifier systems that would require, upon installation, end users to connect a transmission line (e.g., a cable) between the system's power amplifier and antenna.

Figure 1:
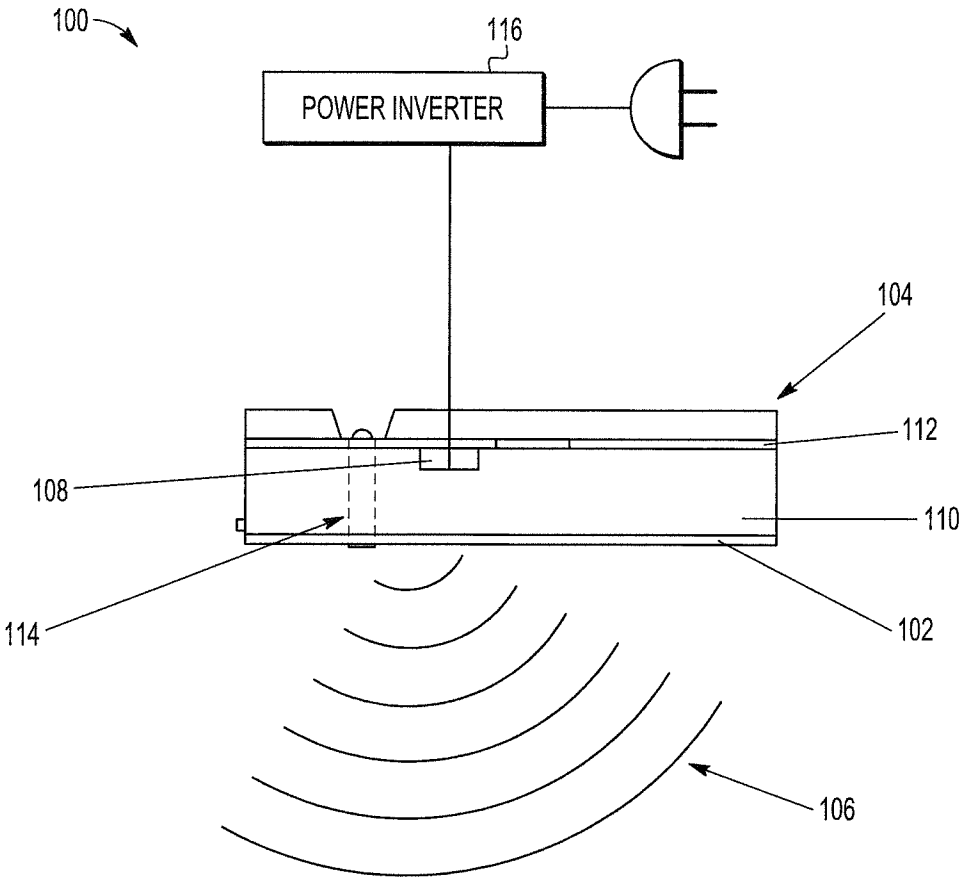
FIG. 1 is a system diagram depicting an operational environment for the present radio frequency (RF) power amplifier device.

FIG. 1 is a system diagram depicting an operational environment for the present radio frequency power amplifier system 100. Radio frequency power amplifier system 100 may be utilized in any application calling for the transmission and/or generation of radio frequency signals. In some cases, radio frequency power amplifier system 100 may be utilized within end-user products, such as ovens, cooking stove tops or wireless communication applications including mobile devices, base stations, and the like.

As depicted in FIG. 1, a power inverter 116 supplies electrical energy to radio frequency power amplifier system 100. Radio frequency power amplifier system 100 includes a power transistor 108 configured to amplify an input radio frequency signal. The amplified signal is then transmitted to antenna 102 that is also integrated into radio frequency power amplifier system 100. Upon receipt of that amplified signal, antenna 102 generates a corresponding radio frequency radiation signal 106 that is outputted or broadcast by antenna 102. Within radio frequency power amplifier system 100, power transistor 108 and antenna 102 are coupled by conductive element 114 that operates as a transmission line.

Because radio frequency power amplifier system 100 incorporates power transistor 108, antenna 102 and conductive element 114, radio frequency power amplifier system 100 is a packaged system enabling relatively straightforward installation into end user devices, in contrast to conventional power amplifier devices, which require the separate installation and connection of the system's power transistor, transmission line, and antenna.

Figure 6:
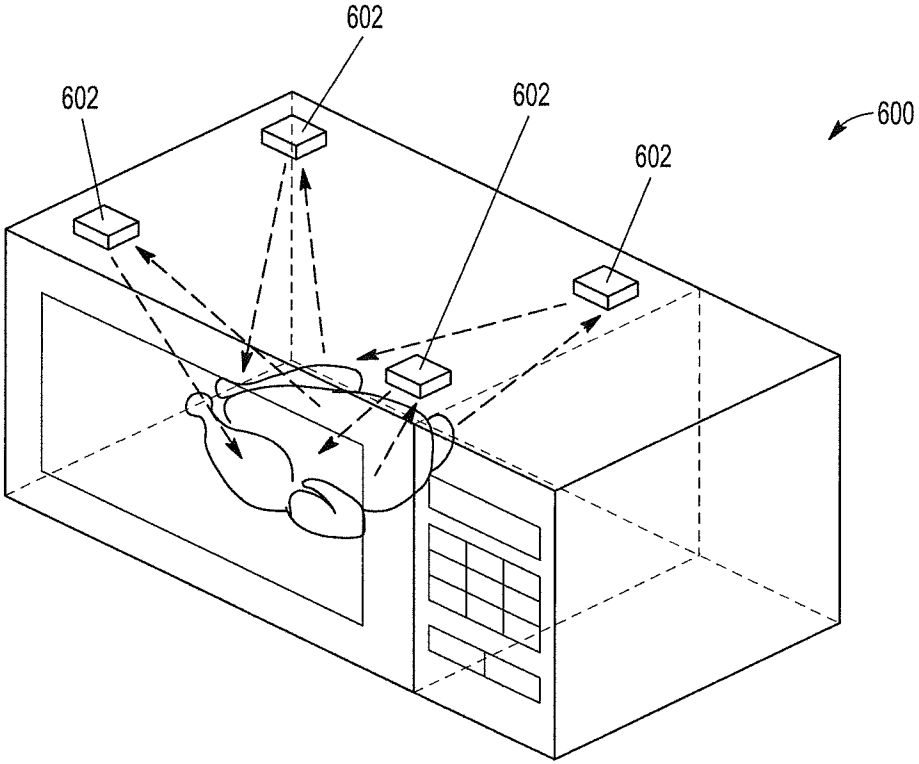
FIG. 6 illustrates an example implementation of the integrated antenna for use within a microwave oven.

In one example use case, radio frequency power amplifier system 100 could be installed as the radiating element of an oven or other cooking device as illustrated in FIG. 6, and described below. In such an arrangement, should radio frequency power amplifier system 100 in such a cooking device fail or require replacement or upgrading, the installation of a new radio frequency power amplifier system 100 could be relatively straightforward.

Within radio frequency power amplifier system 100, substrate 112 is mounted to a first surface of housing 110. A number of electrical components, such as power transistor 108, may be mounted to one or more surfaces of substrate 112. Substrate 112 may include a printed circuit board (PCB), a laminated board or any other suitable substrate upon which the electrical components may be mounted.

Heat sink 104 is coupled to housing 110 over substrate 112. Heat sink 104 is generally configured to extract heat energy from components coupled to housing 110, such as power transistor 108. Heat sink 104 generally includes aluminum, copper, or other metal or heat-conducting materials. In one embodiment, heat sink 104 is connected to a top surface of housing 110 via one or more mechanical fasteners. To facilitate heat transfer through housing 110 and substrate 112, heat sink 104 may be coupled to housing 110 using a heat-conductive epoxy or other suitable adhesive material or mechanical attachment.

Antenna 102 is mounted to a bottom surface of housing 110. As shown in FIG. 1, antenna 102 connects to power transistor 108 via conductive element 114 and is configured to radiate radio frequency radiation waves out of radio frequency power amplifier system 100.

Figure 2A:
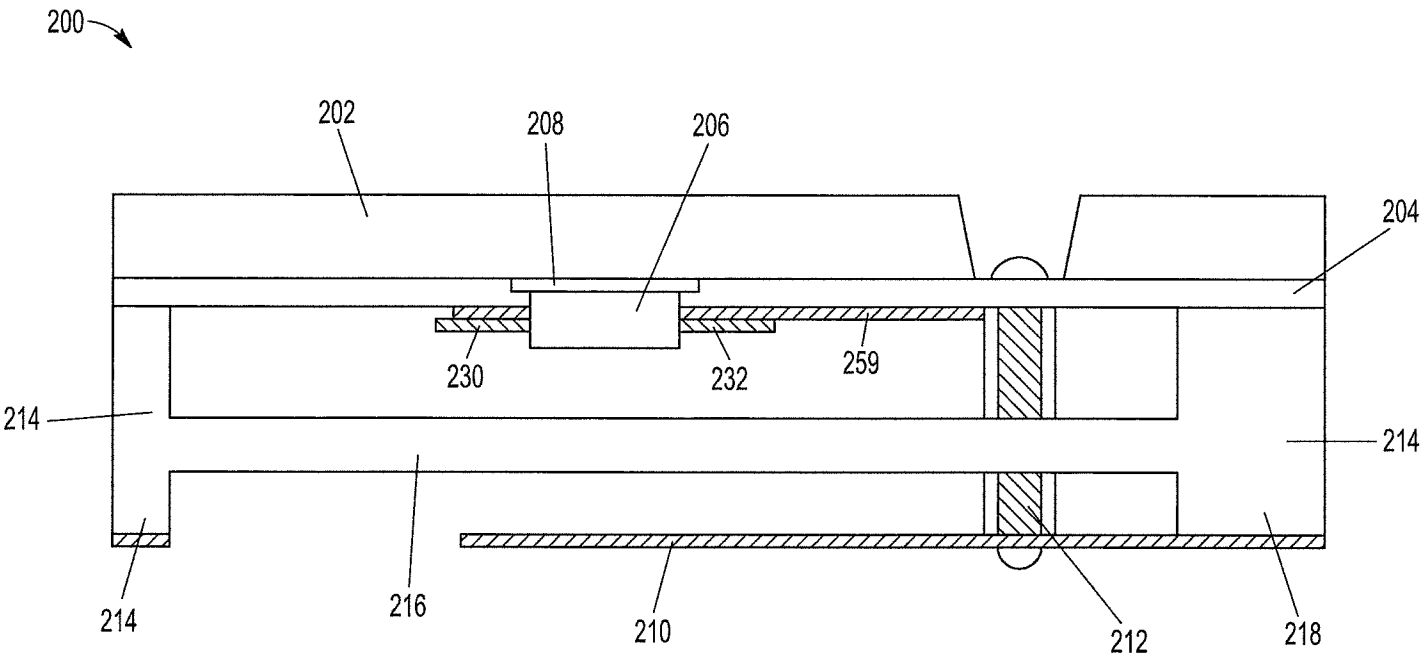
FIG. 2A shows a cross-sectional view of a device with an integrated antenna.
Figure 2B:
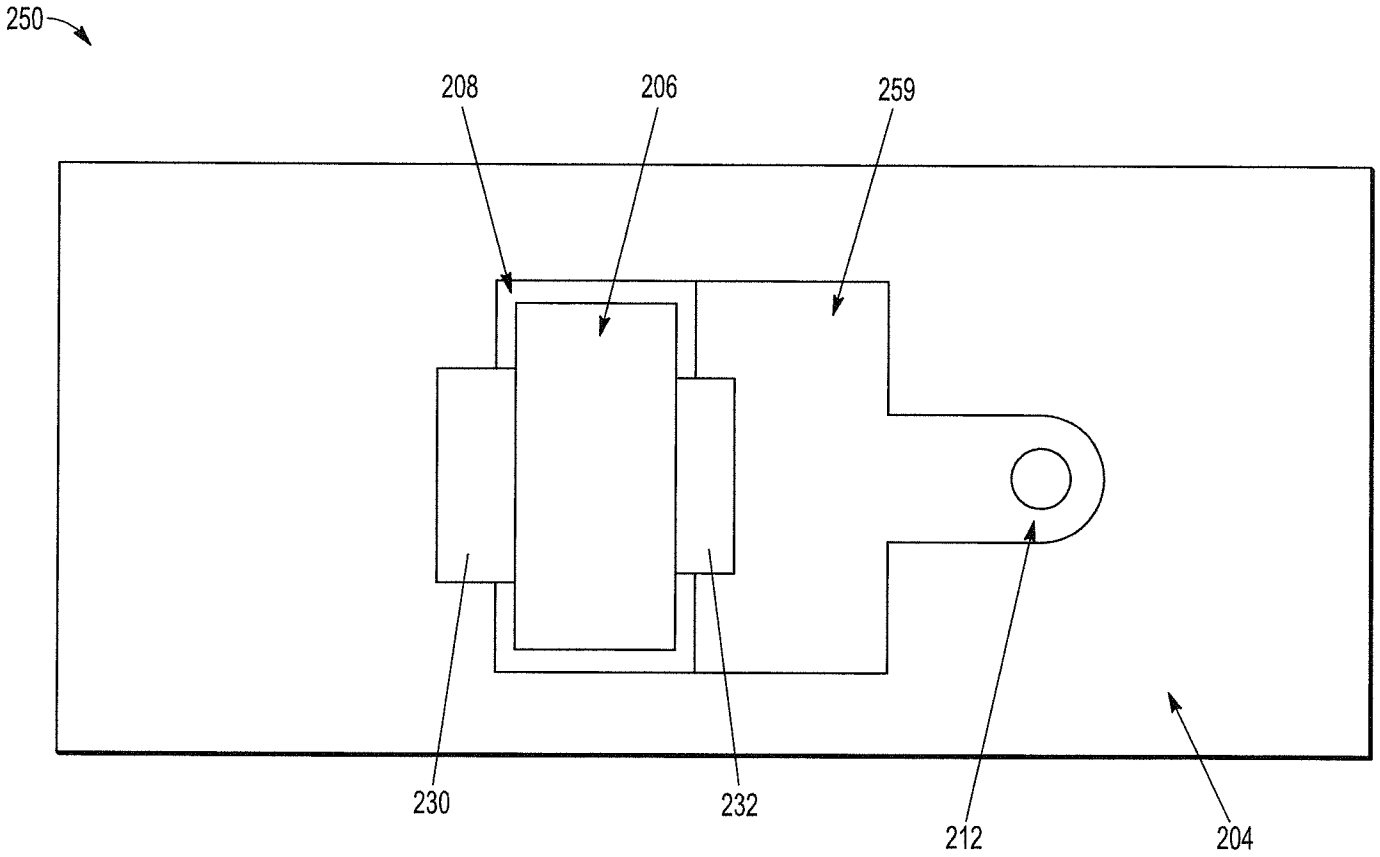
FIG. 2B shows a bottom view of the circuit board of the device illustrated in FIG. 2A.
Figure 2C:
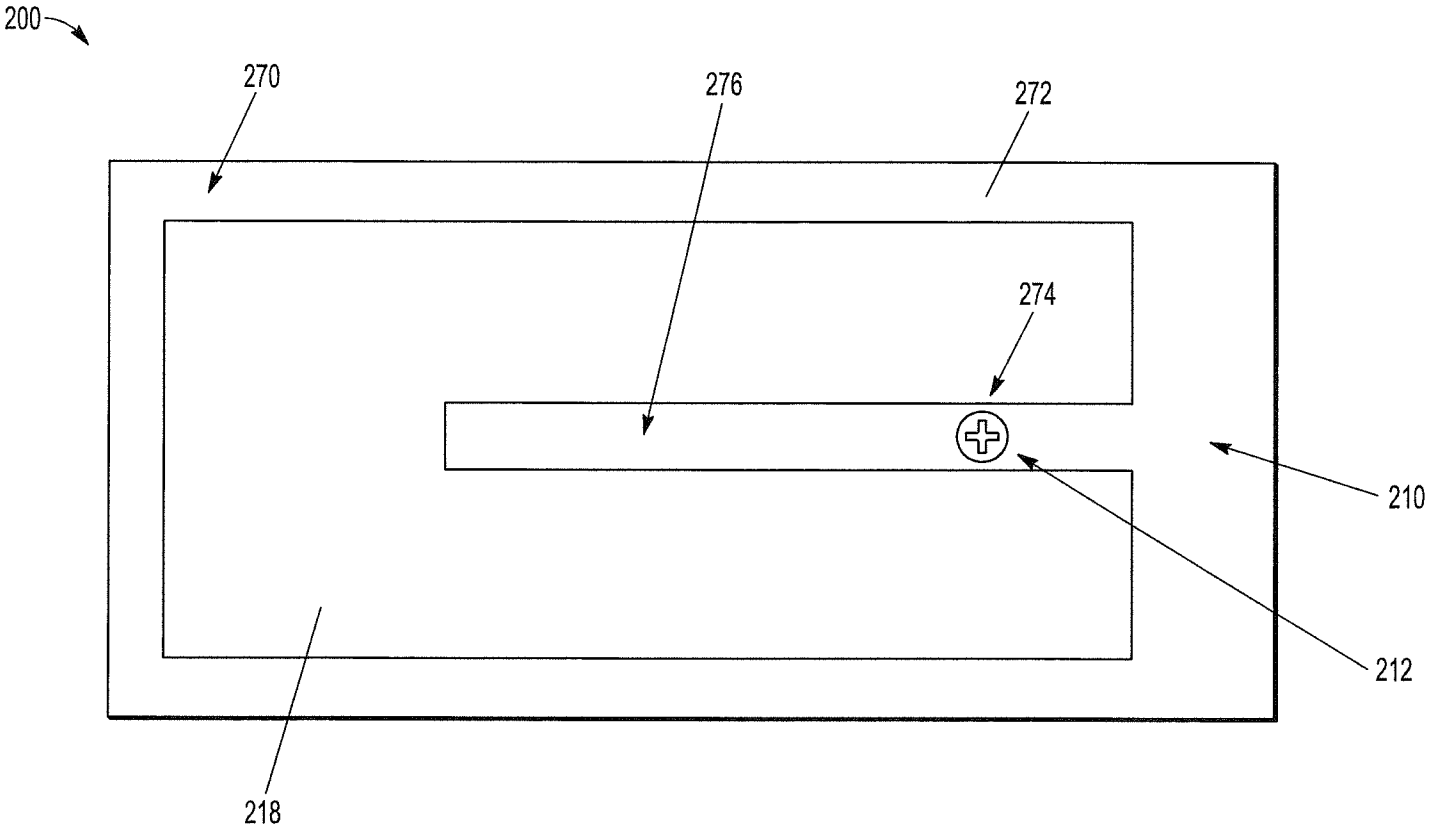
FIG. 2C shows a bottom view of the device illustrated in FIG. 2A.

FIGS. 2A-2C depict cross-sectional, top, and bottom views, respectively, of a radio frequency power amplifier system having an integrated antenna. As shown in FIG. 2A, radio frequency power amplifier system 200 includes a housing 218. Generally, the housing 218 includes a material suitable for providing structural support to the various components of radio frequency power amplifier system 200. The housing may be made of metal materials such as steel or aluminum. During operation of radio frequency power amplifier system 200, housing 218 may operate to block or reduce the propagation of electronic signals from outside housing 218 (and, specifically those signals being generated by antenna 210) into the electronic components of radio frequency power amplifier system 200. As such, housing 218 may be referred to as a shield or cover for radio frequency power amplifier system 200. As shown by FIG. 2A, housing 218 has an "H" shaped cross-sectional structure, with a number of components of radio frequency power amplifier system 200 being coupled to housing 218.

Radio frequency power amplifier system 200 includes circuit board 204, which operates as a suitable structure or substrate over which one or more electronic components of radio frequency power amplifier system 200 may be mounted. Circuit board 204 is mounted to housing 218 as shown in FIG. 2A. Specifically, circuit board 204 is attached to the ends of side walls 214 of housing 218.

Power transistor 206 is mounted to circuit board 204. Power transistor 206 may include, for example, one or more integrated circuit die and other circuitry, including input lead(s) 230, output lead(s) 232, and bias lead(s) (not shown), which are coupled to a common package substrate. The integrated circuit die within power transistor 206 may include one or more transistor devices, which form portions of one or more single-stage or multiple-stage amplifiers. Each transistor within each die may have a control terminal (e.g., a gate) and first and second current-carrying terminals (e.g., source and drain terminals). The control terminal of the input-stage transistor device is electrically connected to an input lead 230, and is configured to receive a relatively low-power input RF signal. A current-carrying terminal (e.g., the drain terminal) of the output-stage transistor device is configured to output an amplified version of the low-power input RF signal, and is electrically connected to an output lead 232. In one embodiment, transistor 206 is mounted to circuit board 204 using heat sink 208 structure. Heat sink 208 may include aluminum, copper, composite materials, or other materials suitable for extracting or absorbing heat generated by transistor 206 during its operation. As illustrated, at least a portion of heat sink 208 protrudes through a top surface of circuit board 204.

A further heat sink or heat spreader structure 202 is mounted over housing 218. In this configuration, circuit board 204 and transistor 206 are mounted at least partially between housing 218 and heat sink 202, or more specifically within an air cavity defined between parallel surfaces of the housing 218 and circuit board 204 that face each other, as well as the interior surfaces of the sidewalls 214. In some embodiments, the housing 218 may be configured to completely enclose the air cavity. Heat sink structure 202 generally includes aluminum, copper, or other metal materials such as steel or silver. In one embodiment, heat sink structure 202 is connected to a top surface of housing 218 via one or more mechanical fasteners. To facilitate heat transfer through housing 218 and circuit board 204, heat sink 202 may be mounted directly to circuit board 204 using a heat-conductive epoxy or other suitable adhesive material.

During operation of radio frequency power amplifier system 200, the heat generated by transistor 206 may be extracted directly from transistor 206 by heat sink 208. The heat is then transferred from heat sink 208 into the larger heat sink structure 202. Heat sink structure 202 then operates as a heat spreader to distribute the heat into the ambient environment surrounding radio frequency power amplifier system 200.

As shown in FIG. 2A, the radio frequency power amplifier system 200 includes conductive element 212 that extends between circuit board 204 and antenna 210. Transistor 206 (and, specifically, an output node of transistor 206 that is electrically coupled to an output current carrying terminal) electrically connects to one end of conductive element 212 through conductive layer 259 that is formed on a surface of circuit board 204. Alternatively, the conductive layer 259 may be embedded within circuit board 204, or the electrical connection may be formed from interconnected portions of multiple conductive layers. Antenna 210 is electrically coupled to the opposite end of conductive element 212. As such, conductive element 212 puts the output node of transistor 206 and antenna 210 in electrical communication with one another.

FIG. 2B shows the bottom view of the circuit board shown in FIG. 2A (i.e., the surface facing the air cavity) that further illustrates the connection between transistor 206 and conductive element 212. As shown in FIG. 2B, transistor 206 is attached to circuit board 204. Transistor 206 is electrically connected with conductive element 212 via conductive layer 259. Conductive layer 259 includes a layer of conductive material that may be formed by applying or plating conductive materials such as copper or aluminum on a surface of or within circuit board 204. FIG. 2B also depicts a portion of heat sink 208, which, as described above, is also mounted on the circuit board 204 behind transistor 206 to extract heat from transistor 206.

FIG. 2C shows a bottom view of radio frequency power amplifier system 200 of FIG. 2A. As illustrated, antenna 210 is coupled to the bottom of housing 218. For example, antenna 210 may be coupled to opposite ends of the sidewalls 214 from the ends to which circuit board 204 is coupled. Antenna 210 may be coupled to housing 218 using any suitable mechanism such as mechanical fasteners or adhesive materials. Generally, antenna 210 has a flat or planar configuration, and is formed from electrically conductive materials. In the configuration shown in FIG. 2C, antenna 270 has an outer perimeter that is coextensive with a perimeter of the bottom surface of housing 218 of radio frequency power amplifier system 200.

The antenna 210 depicted in FIG. 2C may be referred to as a mono-pole antenna. A monopole antenna is a class of radio antenna consisting of a straight rod-shaped conductor. In this example, the central radiating element 276 of the antenna 210 operates as the straight rod-shaped conductor of the mono-pole antenna 210. In such a configuration, outer ring 272 of the antenna 210 may be coupled to a ground node (e.g., a direct current (DC) ground node), as described with respect to FIGS. 4-5, below, to operate as a ground plane for the mono-pole antenna. Another portion of the antenna 210 alternatively may be coupled to the ground node. In various embodiments, antenna 210 may be a low profile antenna having a thickness (i.e., the dimension into the page in FIG. 2C) less than 1 millimeter. In other embodiments, the thickness of antenna 210 may be less than or equal to about 1/10th of the wavelength of an operating frequency of power transistor 206.

Central radiating element 276 of the antenna 210 is electrically connected an antenna feed point 274. The antenna feed point 274 is the point at which conductive element 212 electrically couples to antenna 210. As such, the signal outputted by transistor 206 is injected into antenna 210 at antenna feed point 274.

It will be apparent that by adjusting the relative position of antenna feed point 274 within the antenna 210 as well as the shape or configuration of antenna 210, antenna 210 may be operated as a dipole antenna, for example. In other embodiments, different antenna configurations may also be incorporated into the present radio frequency power amplifier system 200. For example, antenna 210 could be patch antenna made up of one or more layers of conductive material. Antenna 210 could also be implemented as a spiral antenna, in which case the spiral antenna could be formed over a surface of a suitable substrate (e.g., a PCB), which could, in turn, be mounted to housing 218.

Figure 3:
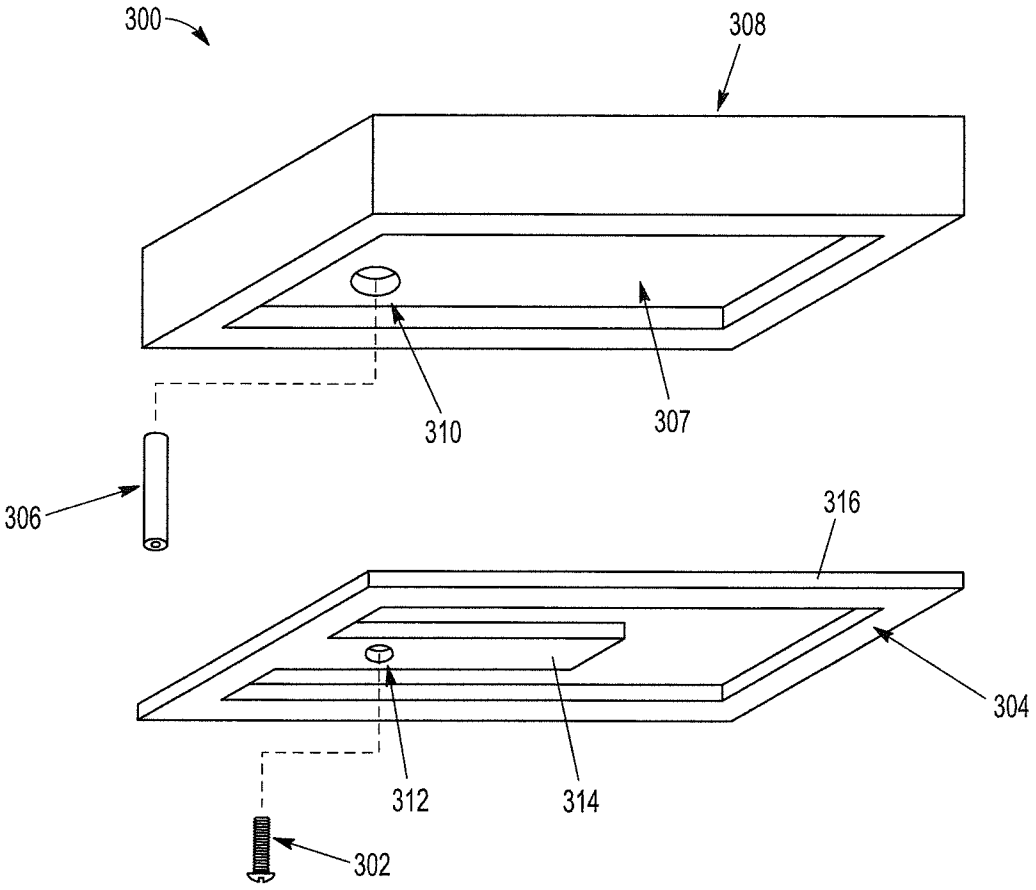
FIGS. 3 and 4 are exploded-view illustrations depicting the connections formed between an integrated antenna, housing, and circuit board of the present radio frequency power device.
Figure 4:
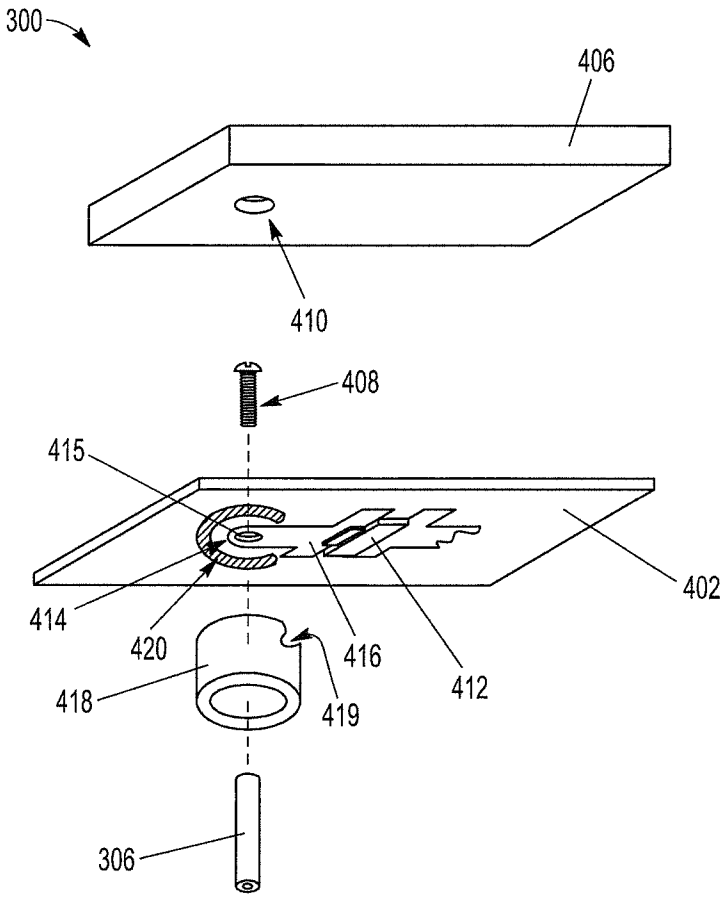
Figure 5:
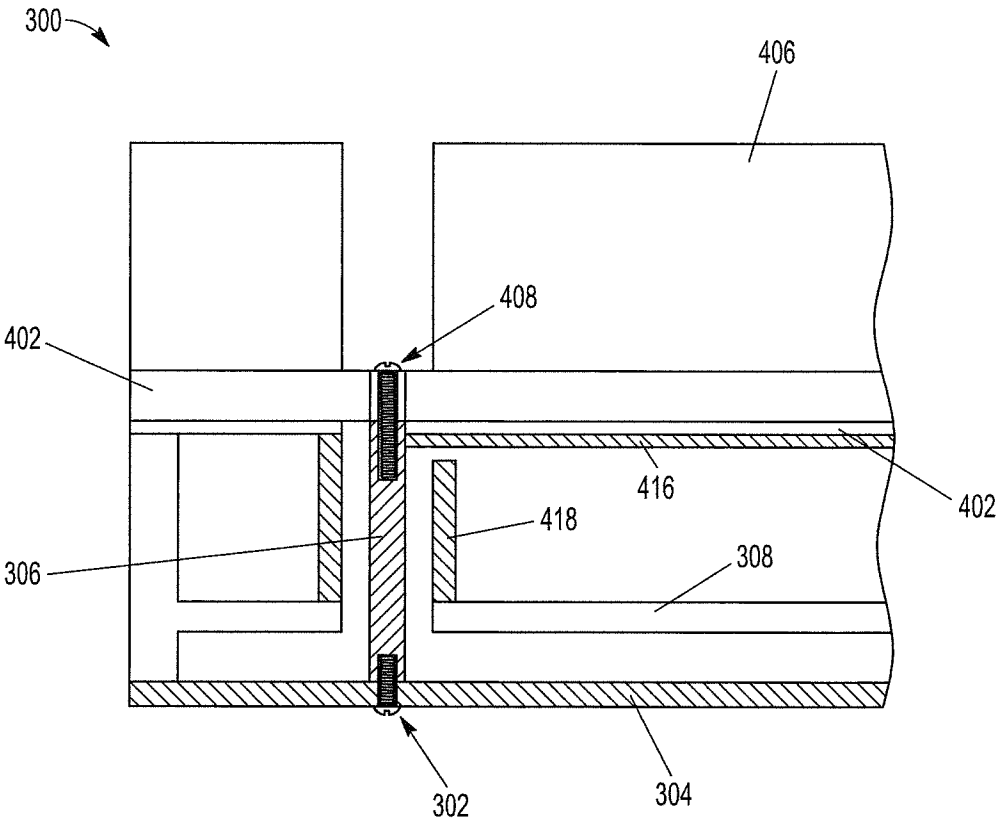
FIG. 5 shows a cross-sectional view of an example embodiment of a device that uses a conductive element to connect an antenna to a circuit board having a transistor.

To further illustrate the interconnections between components of the present power amplifier system, FIGS. 3-4 show an exploded view of a power amplifier device in accordance with the present disclosure. FIG. 3 illustrates a first, lower view or portion of device 300, while FIG. 4 shows a second, upper view or portion of the device 300. FIG. 5 depicts a cross section of a portion of the power amplifier device 300 after fabrication and all the components illustrated in FIGS. 3 and 4 have been connected to one another.

Specifically, FIG. 3 shows the interconnections between the antenna 304, housing 308, and conductive element 306 (note that conductive element 306 is duplicated across FIGS. 3 and 4) of radio frequency power amplifier system 300. Antenna 304 is a generally planar structure including a conductive material, such as copper, steel or aluminum. An outer perimeter of antenna 304 generally matches or is coextensive with a perimeter of housing 308. As such, when antenna 304 is coupled to housing 308, both antenna 304 and housing 308 will have at least approximately the same perimeter. In other embodiments, however, the outer perimeter of antenna 304 and housing 308 may not be coextensive and may instead be different from one another.

Antenna 304 in this example is a monopole antenna having an approximately centrally-located feed point 312. Antenna 304 also includes an outer ring structure 316 formed around central radiator structure 314 to provide physical stability and a mounting structure for coupling antenna 304 to housing 308. Housing 308 is formed with a central recess 307. Because of recess 307, when antenna 304 is mounted to housing 308, only outer ring 316 of antenna 304 is in contact with housing 308. In this configuration, central radiator structure 314 of antenna 304 is suspended away from housing 308 and is not, therefore, in contact with housing 308.

Conductive element 306 is fed through hole 310 of housing 308. Conductive element 306 may, in some embodiments, operate as a matching element configured to couple antenna 304 to transistor 412 while providing an impedance match between antenna 304 and transistor 412. Conductive element 306 is generally cylindrical and includes at each end of conductive element 306 a threaded recess configured to receive a screw or other mechanical fastener. As illustrated in FIG. 3, screw 302 is coupled to a first end of conductive element 306 through the hole at feed point 312 of antenna to secure conductive element 306 to antenna 304. This also electrically couples conductive element 306 to antenna 304. As shown further in FIG. 4, conductive element 306 ultimately electrically connects transistor 412 of radio frequency power amplifier system 300 to the integrated antenna 304.

In order to electrically connect transistor 412 with antenna 304, conductive element 306 may be made of conductive materials such as copper, aluminum or steel. Because conductive element 306 forms a portion of the electrical connection between transistor 412 and antenna 304, conductive element 306 forms at least a portion of a transmission line connecting transistor 412 and antenna 304. As such, for a given application, the dimensions of conductive element 306 can determine the impedance of that transmission line. When a given application calls for transistor 412 to output signals having a particular frequency (e.g., radio frequency signals having frequencies of about 2450 megahertz or some other frequency), antenna 304 may not present the ideal impedance for transistor 412. In that case, the length and impedance of conductive element 306 can be selected to transform that impedance to a better match between antenna 304 and transistor 412.

FIG. 4 shows the interconnections between conductive element 306, circuit board 402 (and the electrical components on circuit board 402), and heat sink 406. As shown, transistor 412 is mounted to a bottom surface of circuit board 402. An output lead of transistor 412 is connected to conductive layer 416. Conductive layer 416 is a layer of conductive material that is formed upon a surface of circuit board 402. Conductive layer 416 includes a layer of conductive material that may be formed by applying or plating conductive materials such as copper or aluminum on a surface of or within circuit board. Conductive layer 416 also forms trace 415 around hole 414. Hole 414 is formed through circuit board 402.

As shown in FIG. 4, circuit board 402 also has an at least partially circular trace 420 that is formed over the bottom surface of circuit board 402 around trace 415. Trace 420 may be formed, for example, by plating a conductive material over a surface of circuit board 204. The centers of the at least partial circles formed by both trace 415 and trace 420 correspond to the center of hole 414 in circuit board 402. Trace 420 may be coupled to a ground node (e.g., a direct current (DC) ground node). Trace 420 is electrically isolated from trace 415, such as by a portion of the top surface of substrate 402.

When circuit board 402 is coupled to housing 308, a second end of the conductive element 306 rests against trace 415, electrically connecting conductive element 306 to transistor 412 through conductive layer 416. Conductive element 306 is then fixed against substrate 402 by screw 408, which engages a threaded recess formed in the second end of the conductive element 306 through hole 414.

At the time circuit board 402 is coupled to housing 308, cylindrical conduit 418 may be positioned around conductive element 306. Conduit 418 is an optional component that includes any suitable electrically conductive material. In this configuration the top surface of conduit 418 rests against trace 420 and may, consequently, be electrically coupled to the ground node that is in contact with trace 420. Conduit 418 may include a node or recess 419 so that when installed, conduit 418 does not come into contact with conductive layer 416. When radio frequency power amplifier system 300 is constructed, the bottom surface of conduit 418 rests against housing 308. Because housing 308 includes a conductive material, this configuration can cause housing 308 itself to become grounded through conduit 418 and trace 420. Then, with outer ring 316 of antenna 304 being in contact with the (now grounded) housing 308, outer ring 316 of the antenna 304 becomes similarly grounded (e.g., to a direct-current ground node). As described above, central radiator structure 314 does not contact housing 308 due to recess 307 formed in the housing.

Heat sink 406 is mounted over circuit board 402 using a suitable attachment mechanism. Heat sink 406 includes hole or opening 410, which makes room for the head of screw 408 so that heat sink 406 may be attached flush to circuit board 402.

FIG. 5 shows a cross-sectional view of a portion of radio frequency power amplifier system 300 after the various components have been coupled to one another. In FIG. 5, one side of conductive element 306 is fastened to circuit board 402 by top screw 408, placing conductive element 306 in contact with conductive layer 416, and the other side of conductive element 306 is fastened to the antenna 304 using bottom screw 302. The conductive element 306 in FIG. 5 is made of conductively materials such as steel, copper, aluminum.

As shown in FIG. 5, conduit 418 is positioned about or around conductive element 306 and between the circuit board 402 and housing 308. Conduit 418 may be hollow or may be filled with an electrical insulator material, such as plastic, so that conduit 418 and conductive element 306 may be electrically isolated from one another. In FIG. 5, the upper side of conduit 418 is in contact with circuit board 402 and the bottom part of conduit 418 is in contact with housing 308. As described above, conduit 418 is electrically isolated from conductive layer 416.

The present radio frequency power amplifier system with integrated antenna may be used in many different applications calling for the transmission, reception, or both of radio frequency signals. The system could be used, for example, in wireless communication devices, by integrating the system into mobile phones or computing devices, such as tablets or laptop computers, or base stations enabling the transmission and reception of wireless communication signals. The power amplifier system could be used in other systems calling for the generation of radio frequency signals. In embodiments of other devices (e.g., radar systems, communication systems, and so on) that include embodiments of radio frequency power generation modules, the present system may be utilized to radiate microwave energy within a relatively wide bandwidth (e.g., a bandwidth anywhere within the microwave spectrum of about 800 megahertz to about 300 gigahertz).

In some instances, the present system may be incorporated into cooking devices, which may use high energy radio frequency signals to heat or cook food. For example, as depicted in FIG. 6, a number of power amplifier systems 602 with integrated antennas may be utilized within a cooking appliance 600. During operation of cooking appliance 600, a user (not illustrated) may place one or more objects (e.g., food and/or liquids) into the heating chamber, and may provide inputs via a control panel that specify a desired heating duration and a desired power level. In response, a system controller (not illustrated) causes power amplifier systems 602 in cooking appliance 600 to radiate electromagnetic energy in the microwave spectrum (referred to herein as "microwave energy") into the heating chamber. The microwave energy increases the thermal energy of the object (i.e., the microwave energy causes the object to heat up).

In such an implementation, each power amplifier system 602 is configured to produce and radiate microwave energy into the heating chamber. The radiated energy has a wavelength in the microwave spectrum that is particularly suitable for heating liquid and solid objects (e.g., liquids and food). For example, each power amplifier system 602 may be configured to radiate microwave energy having a frequency in a range of about 2.0 gigahertz to about 3.0 GHz into the heating chamber. More specifically, each power amplifier system 602 may be configured to radiate microwave energy having a wavelength of about 2.45 gigahertz into the heating chamber, in an embodiment. Although each power amplifier system 602 may radiate microwave energy of approximately the same wavelength, power amplifier systems 602 may each radiate microwave energy of different wavelengths from each other, as well.

An embodiment of a system includes a housing, a substrate attached to a first side of the housing, and an amplifying device on the substrate. The amplifying device includes an output node. The system includes an antenna attached to a second side of the housing opposite the substrate, and a conductive element passing through the housing. The conductive element electrically connects the antenna to the output node of the amplifying device. The conductive element is connected to the antenna at an antenna feed point.

An embodiment of a system includes a housing having a first surface and a second surface. The second surface defines a recess. The system includes a substrate attached to first surface of the housing, and an amplifying device having an output node. The amplifying device is on the substrate. The system includes an antenna attached to the second surface of the housing over the recess, and a conductive element through at least a portion of the housing. The conductive element electrically connects the antenna to the output node of the amplifying device. The conductive element is connected to the antenna at an antenna feed point over the recess in the housing.

An embodiment of a method includes attaching an amplifying device to a substrate, the amplifying device including an output node, attaching the substrate to a first side of a housing, and attaching an antenna to a second side of the housing opposite the first side. The method includes attaching a first mechanical fastener to a conductive element to attach the conductive element to the substrate, and attaching a second mechanical fastener to the conductive element to attach the conductive element to the antenna to electrically connect the output node of the amplifying device and the antenna.

The terms "first," "second," "third," "fourth" and the like in the description and the claims are used for distinguishing between elements and not necessarily for describing a particular structural, sequential or chronological order. It is to be understood that the terms so used are interchangeable under appropriate circumstances. Furthermore, the terms "comprise," "include," "have" and any variations thereof, are intended to cover non-exclusive inclusions, such that a circuit, process, method, article, or apparatus that comprises a list of elements is not necessarily limited to those elements, but may include other elements not expressly listed or inherent to such circuit, process, method, article, or apparatus. The term "coupled," as used herein, is defined as directly or indirectly connected in an electrical or non-electrical manner.

While the principles of the inventive subject matter have been described above in connection with specific systems, apparatus, and methods, it is to be clearly understood that this description is made only by way of example and not as a limitation on the scope of the inventive subject matter. The various functions or processing blocks discussed herein and illustrated in the Figures may be implemented in hardware, firmware, software or any combination thereof. Further, the phraseology or terminology employed herein is for the purpose of description and not of limitation.

The foregoing description of specific embodiments reveals the general nature of the inventive subject matter sufficiently that others can, by applying current knowledge, readily modify and/or adapt it for various applications without departing from the general concept. Therefore, such adaptations and modifications are within the meaning and range of equivalents of the disclosed embodiments. The inventive subject matter embraces all such alternatives, modifications, equivalents, and variations as fall within the spirit and broad scope of the appended claims.

What is claimed is:

1. A system, comprising:

a housing;

a substrate attached to a first side of the housing;

an amplifying device on the substrate, the amplifying device including an output node;

an antenna attached to a second side of the housing opposite the substrate, wherein the antenna includes a central radiating element and an outer ring around the central radiating element; and a conductive element passing through the housing, the conductive element electrically connecting the antenna to the output node of the amplifying device, the conductive element being connected to the antenna at an antenna feed point.

2. The system of claim 1, wherein the antenna has a thickness equal to or less than 1/10th of a wavelength of a frequency of operation of the amplifying device.

3. The system of claim 2, wherein a perimeter of the antenna is coextensive with a perimeter of the housing.

4. The system of claim 1, wherein a portion of the antenna is connected to a direct current ground node through the housing.

5. The system of claim 1, wherein the conductive element is directly connected to the central radiating element of the antenna.

6. The system of claim 1, wherein a length of the conductive element is determined by a frequency of operation of the amplifying device.

7. The system of claim 1, including a conduit between the substrate and the housing and wherein the conduit is positioned around at least a portion of the conductive element.

8. The system of claim 7, wherein the conductive element is attached to the antenna by a first mechanical fastener through the antenna, and the conductive element is attached to the substrate by a second mechanical fastener through the substrate.

9. A system, comprising:

a housing having a first surface and a second surface, the second surface defining a recess;

a substrate attached to the first surface of the housing;

an amplifying device having an output node, wherein the amplifying device is on the substrate;

an antenna attached to the second surface of the housing over the recess, wherein the antenna includes a central radiating element and an outer ring around the central radiating element; and a conductive element through at least a portion of the housing, the conductive element electrically connecting the antenna to the output node of the amplifying device, the conductive element being connected to the antenna at an antenna feed point over the recess in the housing.

10. The system of claim 9, wherein the antenna has a thickness equal to or less than 1/10th of a wavelength of a frequency of operation of the system.

11. The system of claim 9, wherein a perimeter of the antenna is coextensive with a perimeter of the housing.

12. The system of claim 9, wherein the antenna feed point is located in the central radiating element of the antenna.

13. The system of claim 9, wherein a portion of the antenna is connected to a direct current ground node through the housing.

14. The system of claim 9, wherein a length of the conductive element is determined by an operating frequency of the amplifying device.

15. The system of claim 9, including a conduit between the substrate and the housing and wherein the conduit is positioned around at least a portion of the conductive element.

16. The system of claim 9, wherein the conductive element is connected to the antenna by a first mechanical fastener and the conductive element is connected to the substrate by a second mechanical fastener.

17. A method, comprising:

attaching an amplifying device to a substrate, the amplifying device including an output node;

attaching the substrate to a first side of a housing;

attaching an antenna to a second side of the housing opposite the first side, wherein the antenna includes a central radiating element and an outer ring around the central radiating element;

attaching a first mechanical fastener to a conductive element to attach the conductive element to the substrate; and attaching a second mechanical fastener to the conductive element to attach the conductive element to the central radiating element of the antenna to electrically connect the output node of the amplifying device and the antenna.

18. The method of claim 17, including positioning a conduit around at least a portion of the conductive element between the housing and the substrate to connect the conduit to a ground node.

* * * * *